US006340058B1

(12) United States Patent
Dominick et al.

(10) Patent No.: US 6,340,058 B1
(45) Date of Patent: Jan. 22, 2002

(54) HEAT TRIGGERING FIRE SUPPRESSANT DEVICE

(76) Inventors: Stephen M. Dominick, 2118 Fox Run Dr., Lynn Haven, FL (US) 32444; Robert M. Campisi, 1513 S. Kimbrel Ave., Panama City, FL (US) 32404

( * ) Notice: Subject to any disclaimer, the term of this patent is extended or adjusted under 35 U.S.C. 154(b) by 0 days.

(21) Appl. No.: 09/583,019

(22) Filed: May 30, 2000

(51) Int. Cl.[7] ..... A62C 35/02

(52) U.S. Cl. ..... 169/26; 169/29; 169/33; 169/42; 169/73; 239/329

(58) Field of Search ..... 169/26, 29, 33, 169/41, 42, 37, 54, 62, 65, 72, 73, 84, 85, DIG. 3; 239/75, 320, 321, 322, 329, 331, 373, 589, 600; 222/340, 341, 386

(56) References Cited

U.S. PATENT DOCUMENTS

| | | | | | |
|---|---|---|---|---|---|
| 1,098,837 | A | * | 2/1914 | Putnam | 169/29 |
| 1,233,290 | A | * | 7/1917 | Thomson | 169/29 |
| 1,500,946 | A | * | 7/1924 | Krauss | 169/73 |
| 1,825,922 | A | * | 10/1931 | Roessner et al. | 169/26 |
| 2,703,527 | A | * | 3/1955 | Hansen | 169/33 |
| 3,638,733 | A | * | 2/1972 | De Rouville et al. | 169/42 |
| 3,773,111 | A | * | 11/1973 | Dunn | 169/26 |
| 4,088,192 | A | | 5/1978 | Lamond | |
| 5,992,531 | A | | 11/1999 | Mikulec | |
| 6,003,609 | A | | 12/1999 | Walls | |
| 6,230,815 | B1 | * | 5/2001 | Sundholm | 169/42 |

* cited by examiner

*Primary Examiner*—Steven J. Ganey
(74) *Attorney, Agent, or Firm*—William B. Noll

(57) ABSTRACT

A fire suppressant device that may be rendered automatic by exposing the device to an elevated temperature. The preferred device comprises a canister housing with a uniform cross section throughout its length, and includes a piston member disposed for sliding movement within the canister housing. The canister housing, preferably cylindrical, for containing a fire suppressant fluid, features in a preferred embodiment a nozzle mechanism that includes a cap member temporarily fixed to the spray nozzle thereof by a solder having a known melting point. Disposed between the cap member and spray nozzle is a compression spring biasing the cap member. When the canister housing is exposed to temperatures of at least the melting point of the solder, the solder melts or softens allowing the cap member to be released under the influence of the compression spring, whereby fire suppressant fluid within the canister housing is released against a fire.

6 Claims, 3 Drawing Sheets

HEAT TRIGGERING FIRE SUPPRESSANT DEVICE

FIELD OF THE INVENTION

This invention is directed to the field of fire suppressant devices, more particularly to an automatic temperature activated device, a manual device, or a combination thereof, where each version has broad and varied application.

BACKGROUND OF THE INVENTION

The present invention, in a preferred version, relates to a heat responsive fire suppressant device, of the type that may be mounted in a kitchen range hood, along an automotive engine fire wall, or in industrial locations, where fires could erupt suddenly resulting in serious damage, or even injury. Oftentimes such fires can occur when no one is immediately available to use a conventional, hand operated fire extinguisher, or the fire location is not convenient for using such fire extinguisher. In alternate versions, the device may be operated manually, or the device may offer a combination of automatic and manual.

Heat activated fire extinguishers have been proposed which respond automatically to excessive heat to release a pressurized fire retardant agent, where such proposals date back to the 30's. Hand held fire extinguishers have a number of limitations that are not associated with automatic distinguishers. Most manual extinguishers include either a dry or wet flame retardant chemical compound placed under pressure within a cylindrical canister which includes an opening in a bottom end, a siphon tube connected at one end to the opening and at the opposite end to a valve scaled outlet, an activation device, such as a spring biased hand grip, for opening and closing the valve and a nozzle at the end of a hose which can be used to direct the retardant compound toward a flame to be extinguished.

In operation, to extinguish a fire, a user directs the nozzle end of the hose toward the flame and triggers the hand activation device to open the valve. Where the extinguisher includes a hose, the compound is forced therethrough and out of the nozzle end to extinguish the fire. Usually, because the compound must travel through the hose prior to being discharged, hose length is limited so that activation time is reduced, pressure required to force the compound through the hose is minimal and minimal compound is wasted within the hose.

A number of limitations are inherent with such traditional fire extinguishers. To be effective, pressure must be maintained at a minimum level. Some extinguishers may be equipped with a pressure scale to visually show the pressure level. Further, while these extinguishers can put out relatively small fires efficiently, assuming the fire is known to the occupant, these extinguishers are typically not suitable for extinguishing larger fires. However, one must be close to the fire, and such close proximity can be a hazard to the user.

Certain of these disadvantages can be overcome by the use of automatic, heat responsive extinguishers which are strategically placed in areas for potential fire hazards, such as kitchen hoods in homes and restaurants, engines of automobiles and other vehicles, and in industrial applications. The prior art teaches several devices for the automatic operation of a fire suppressing system, where such prior art is reflected in the following U.S. Patents:

a.) U.S. Pat. No. 6,003,609, to Walls, relates to a fire safety device for controlling the spread of fire in a structure. The device comprises a base plate, a smoke detector, a syringe, and a cover. The syringe has a reservoir containing a fire retardant chemical. A fuse link holder has a melting fuse link that maintains a plunger assembly in position, and a spring is loaded behind the plunger. The syringe also has a nozzle in open communication with a supply line, which is in open communication to the reservoir. When a sufficiently high ambient temperature is reached, the fuse link melts, releasing the piston rod from the fuse link and allowing the coil spring to urge the plunger toward the other end of the syringe, and forcing the fire-retardant chemical from the nozzle.

b.) U.S. Pat. No. 5,992,531, to Mikulec, teaches a fire extinguisher including a spring biased plunger controlled by a trigger mechanism. The plunger is mounted in a flame retardant compound container and the spring and plunger cooperate, when the trigger mechanism is activated, to discharge flame retardant compound from the container toward a fire. The extinguisher has a handle end and an outlet end at opposite ends of its length such that a user can hold the outlet end in a remote location away from the user when compound is discharged. The extinguisher can also be mounted and provided with a heat sensor for automatic activation.

c.) U.S. Pat. No. 4,088,192, to Lamond, is directed to a heat actuated valve comprising a base adapted to be mounted on a fire extinguisher container. The base includes a passage communicable with the container interior. A pair of stop fingers extend forwardly from the base. A fusible element interconnects the stop fingers. The base, stop fingers and fusible element are of one-piece, integral construction. A plunger is slidably mounted in the passage and includes a passage-blocking portion which blocks the passage when the plunger abuts the stop fingers during a fire sensing mode of operation. The plunger is slidable rearwardly to shift the passage-blocking portion to a first passage-opening position to allow the container to be filled. The plunger is operable, in response to melting of the fuse, to spread the stop fingers apart and travel forwardly sufficiently to shift the passage-blocking portion to a second passage-opening position, enabling the container contents to be discharged.

While the above prior art, and other known devices, propose solutions to the general subject of automatic, heat activated fire suppressing devices, none offer the simplicity, reliability and fast response of preferred the heat activated fire suppressant device of this invention. Further, these prior art designs significantly limit the location and environment for effective operation. The manner by which the present invention achieves these features will become more apparent to those skilled in the art from the description which follows.

SUMMARY OF THE INVENTION

This invention preferably relates to a temperature activated fire suppressing device having particular utility in applications where unattended or unexpected fires may erupt. The device, in a preferred embodiment, comprises a cylindrical canister housing, having a uniform bore, and mounting a removable end cap containing a fluid exiting conduit leading to a nozzle mechanism. Alternately, the housing may have different shapes so long as it exhibits a uniform bore throughout. Movable within the cylindrical or different shaped housing is a piston member, cylindrical or comparable shaped to the housing, and axially slidably therewithin, where the piston member is in sealing contact with the inner wall of the housing. The piston member is movable from a first position to a second position by a pressurized fire suppressant fluid in combination with an energy means, where said energy means may be selected from the group consisting of (a) at least one elastic member extending between the end cap and the piston member, and (b) a coil spring positioned behind the piston member. The nozzle mechanism comprises a nozzle opening in communication with the fluid exiting conduit, and a closed cover member. Further, there is a biasing spring acting between said cover member and said nozzle opening to facilitate its removal from the nozzle opening. The closed cover member is temporarily secured to the nozzle opening by a low temperature melting point solder. By this arrangement, when the device is exposed to a fire having a temperature in excess of said low temperature melting point, the solder melts, and with the force of the biasing spring the closed cover member is released from the nozzle opening. With the nozzle opening in communication with the fire suppressant fluid, the fluid is released to act on the fire and is forced out of the device by the release of the stored energy of the energy means. During this releasing action, the piston member is caused to move from said second position to said first position.

Accordingly, an object of a preferred embodiment of this invention is to provide a convenient and reliable fire suppressing device that is activated by exposure to heat.

Another object of the preferred embodiment lies in the use of a heat activated cover member that includes a compressed coil spring to facilitate its separation from the fluid transmission nozzle.

A further object of the invention is a fire suppressing device that can be converted to a manually operated device.

Still a further object hereof is the provision of piston member in fluid sealing and sliding relationship to the inner wall of the cylindrical or different shaped canister housing.

These and other objects will become more apparent from the specification which follows particularly when read by those skilled in the art.

DETAILED DESCRIPTION OF PREFERRED EMBODIMENT

Figure 1:
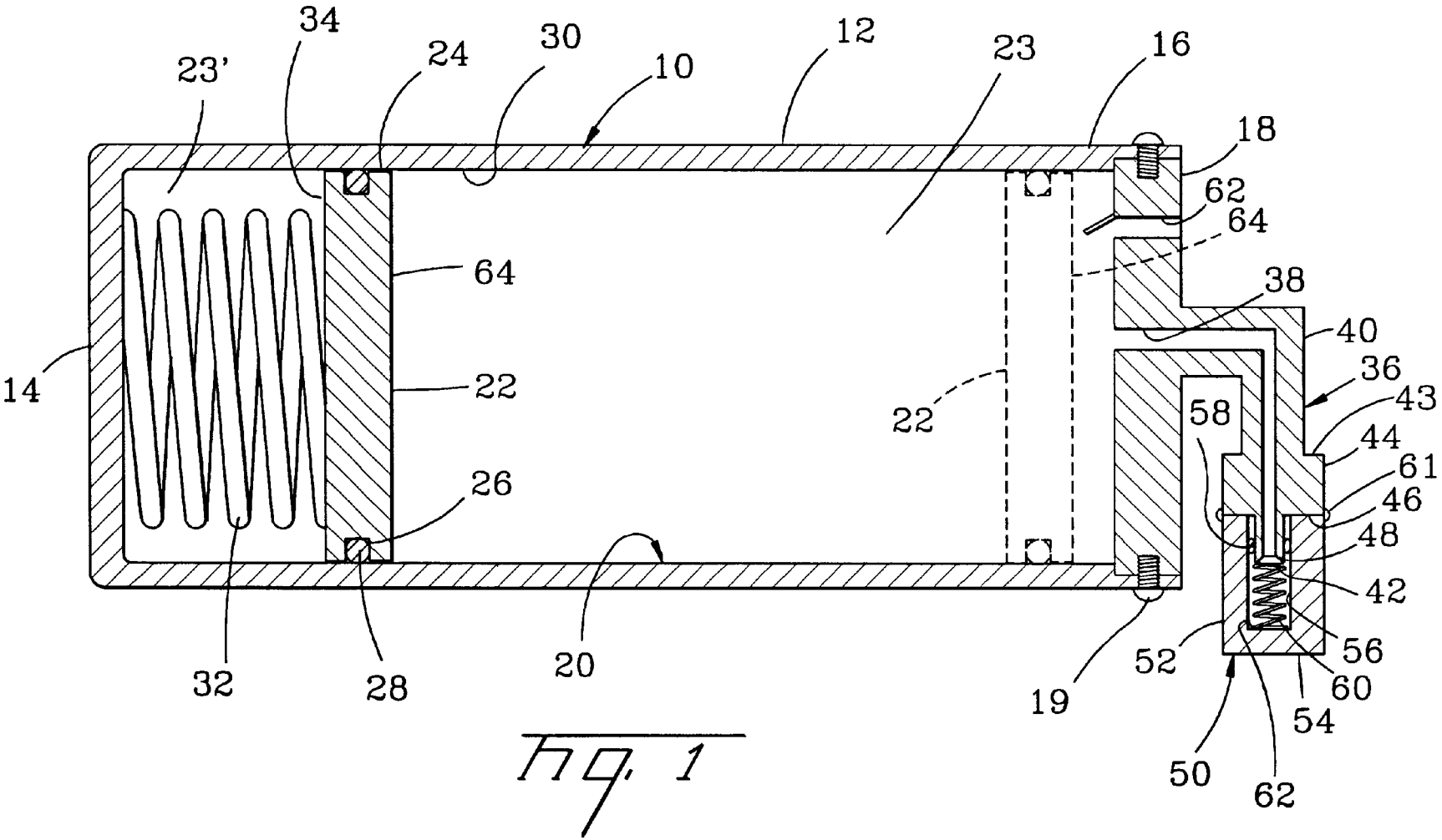
FIG. 1 is a sectional view of a first embodiment for the temperature activated fire suppressant device according to this invention.

The present invention is directed, in a preferred form, to an automatic, temperature responsive fire suppressing device. However, said device may be constructed to function as a manually activated fire suppressing device, or a combination automatic and manual. Notwithstanding the above, the further description will be directed principally to the preferred version. The inventive device hereof will now be described with regard to the accompanying Figures, where like reference numerals represent like components or features throughout the several views.

FIG. 1 illustrates a first embodiment for the fire suppressing device 10 of this invention. The device 10 preferably comprises a cylindrical canister housing 12 having a uniform bore throughout its length. However, other shapes are contemplated so long as the bore is uniform along its length. In any case, the rear end 14, as shown in FIG. 1, may be integral with the housing body, or in the alternative as a separate component fixed to the housing body. The opposite end 16 includes an end cap member 18 secured to the canister housing 12, by peripheral fasteners 19, for example, to define, with the canister housing, an internal cavity 20. In sliding and fluid sealing engagement with the bore of said canister housing 12 is a piston member 22. With the reciprocal nature of the piston member, the internal cavity 20 thus consists of two axially changing sub-cavities, a forward fluid receiving sub-cavity 23, and a rearward sub-cavity 23'. In a preferred sealing mode for a cylindrical canister, the peripheral face 24 of the piston member 22 includes a continuous rectangular configured slot 26 to receive a continuous O-ring 28. With the slot 26 so configured, the O-ring 28 may be compressed into the slot to help provide a fluid sealing relationship between the piston member 22 and the wall 30 of said bore. For canisters of a non cylindrical shape, using a comparably shaped sealing member, a peripheral sealing member about the piston is preferred. Regardless of the canister and piston shape, it is contemplated that other fluid sealing means may be substituted for the O-ring or peripheral sealing member.

In the embodiment of FIG. 1, movement of the piston member 22 is effected by compression spring or springs 32 positioned within sub-cavity 23', extending between rear end 14 and rear face 34 of piston member 22, where the piston member 22 is shown in the charged mode in solid lines, and in dotted lines in the exhausted or fluid depleted mode. The operation of the spring 32, and the manner by which it effects movement of the piston member 22 will become clearer hereafter.

Figure 2:
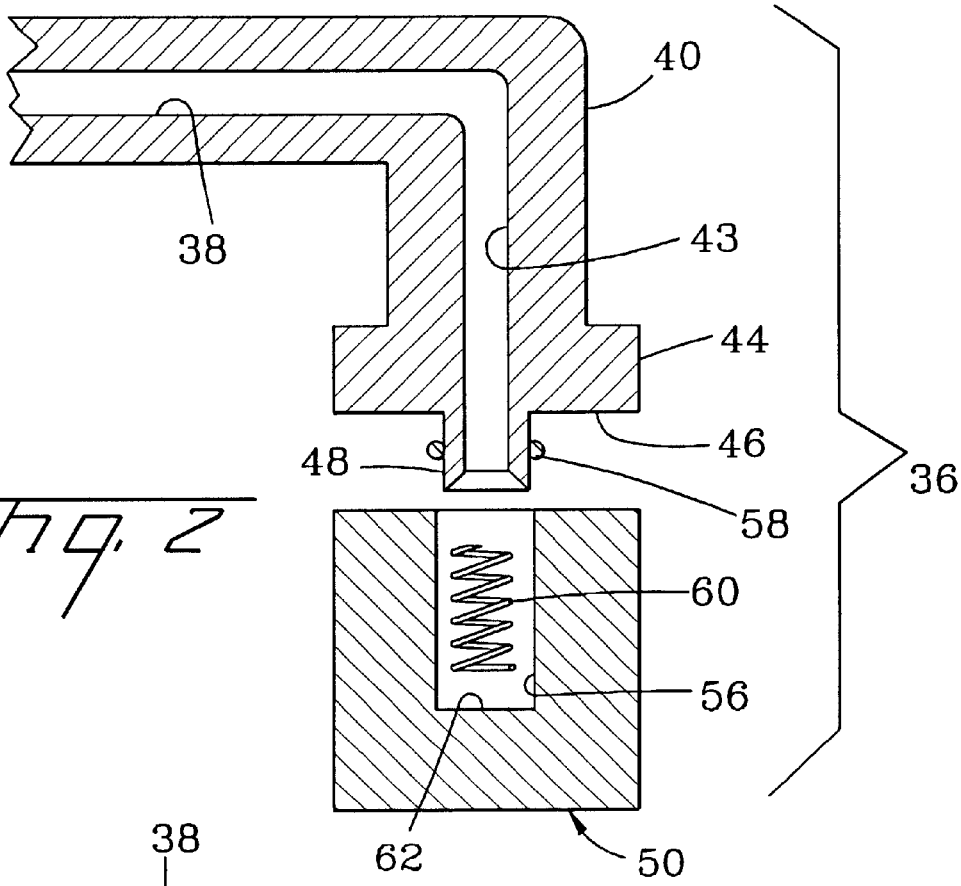
FIGS. 2 and 3 are enlarged sectional views, showing an exploded and an assembled view, respectively, illustrating the nozzle and end cap mechanism for the fire suppressant device hereof.
Figure 3:
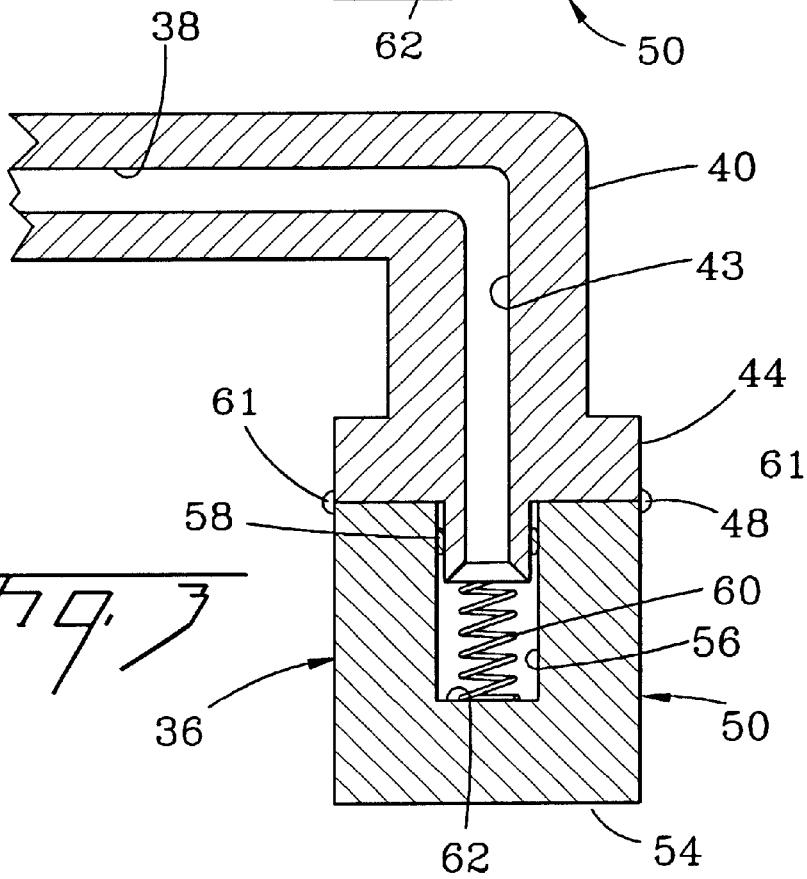

The preferred nozzle mechanism 36, shown at the right in FIG. 1, is best illustrated in FIGS. 2 and 3. The nozzle mechanism 36, in fluid communication with sub-cavity 23, through end cap member 18 via opening 38, comprises a generally circular housing 40 having a spray opening 42 in communication with said opening 38 via conduit 43. The circular housing 40, at its distal end, features a circular body portion 44 of a first diameter, a shoulder 46, and an axially extending concentric portion 48 with a diameter less than said first diameter. Adapted to override and be temporarily secured to the circular body portion 44 is an end cap 50. The end cap consists of a cylindrical member 52, closed at one end 54, having a central bore 56. The bore 56 is sized to slidable engage said concentric portion 48, where said concentric portion may be provided with an O-ring 58 to ensure a fluid sealing relationship between the respective components. Additionally, a compression coil spring 60 is provided to be slidably received in the central bore between the bore end 62 and the concentric portion 48. Thus, by the stored energy of the compressed coil spring 60, there is the tendency to separate the end cap 50 from the circular body portion 44. The separated components represents the operating mode for the fire suppressing device of the invention.

FIG. 3 illustrates the inoperative mode for the preferred automatic device 10 hereof. It will be seen that the end cap 50, with coil spring 60 in place, is positioned on shoulder 46 and soldered about the seam of the circular body portion 44. It should be noted that in place of the seam soldering, a solder pin (not shown) may be used, where the pin is inserted into the body portion 44 and an aligned recess in the concentric portion 48. As understood in the art, there are a number of low temperature melting solders, having a known fixed melting point, that can be used to temporarily join the components as noted above. That is, when the device 10 hereof is exposed to a temperature in excess of the melting point of the solder, the solder 61 (a pin or about the seam of end cap 50 and body portion 44) melts or softens to allow the end cap 50 to be released from the circular body portion 44 under the influence of the coil spring 60. With the end cap 50 removed, the pressurized fire suppressant fluid in sub-cavity 23 is free to exit the system through conduit 43 and spray opening 42. The exit of the fluid is facilitated by the stored energy of compression spring(s) 32 acting against the piston rear face 34. This produces a pressurized spray of such fluid as it exits the spray opening onto the fire.

To recharge the device, after restoration of the end cap 50 and coil spring 60, and resoldering 61 of the end cap to the circular body portion 44, or solder pin replacement, new fire suppressing fluid may be injected into the canister housing through one-way valve 62 in end cap member 18. As the fluid enters into sub-cavity 23, the pressure thereof acts against the front face 64 of piston member 22 forcing the piston member towards the rear end 14. Concurrent with this action, the compression spring 32 is further compressed storing energy for later evacuation of the sub-cavity 23, in the manner discussed above, should another fire be detected.

Figure 4:
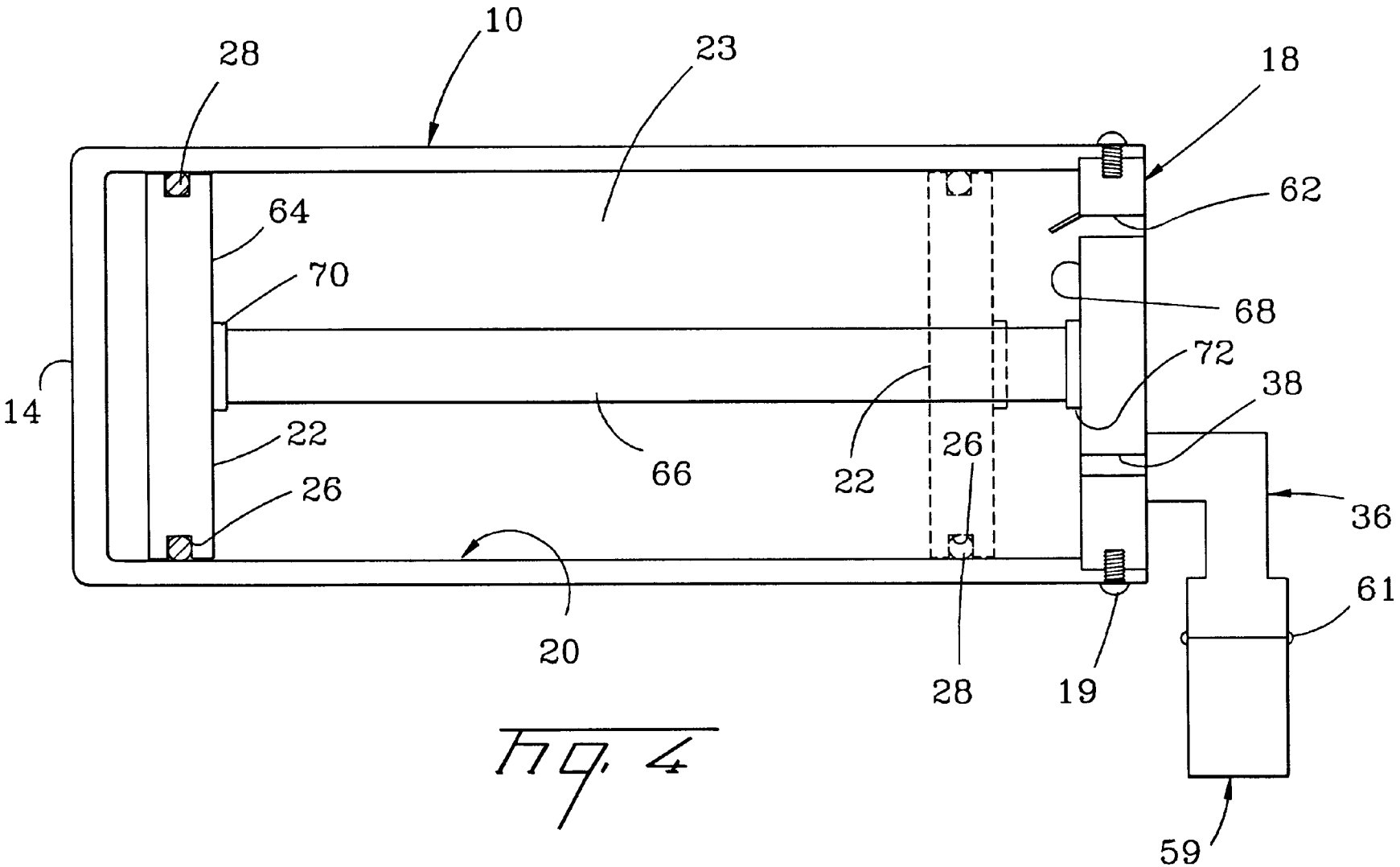
FIG. 4 is a sectional view, similar to FIG. 1, showing a second embodiment for the temperature activated fire suppressant device of this invention.

FIG. 4 is an alternate embodiment to the device illustrated in FIG. 1. For this alternate embodiment, the energy means for assisting the evacuation of the sub-cavity 23 may comprise at least one elastic member 66 extending between the piston front face 64 and the inside face 68 of end cap member 18 by fastening means 70, 72, respectively. In the refilling procedure described above, the elastic member(s) 66 are stretched with the result of an energy buildup. Upon release of the fluid, either by the removal of end cap 50, as noted above, or by a manual means, the stored energy pulls the piston member 22 towards the end cap member 18 forcing the fluid out through the nozzle mechanism 36. With each embodiment of FIGS. 1 and 4, the end cap member 18 may be further modified by a manually operable valve so as to allow use of the device 10 to manually put out a fire, where the valve may be connected to a hose having a hand held ON/OFF dispensing nozzle, as known in the art.

It is recognized that changes, variations and modifications may be made to the fire suppressing device of this invention, particularly by those skilled in the art, without departing from the spirit and scope hereof. It is contemplated that the device hereof may have the dual purpose of both automatic and manual. Further, It may be desirable to incorporate a switch activation means, such as to activate contacts, to set off an alarm, activate a power breaker or anything electrical, or to turn off lights, by way of example, where the switch means may be activated during movement of the piston from the normally open position to the normally closed position, or even by a pressure drop within the canister. Accordingly, no limitation is intended to be imposed on the invention except as set forth in the following claims.

What is claimed is:

1. A fire suppressing device automatically operable by exposure to fire temperatures of at least a predetermined degree, said device comprising:

(a.) a canister housing of uniform cross section for containing a fire suppressing fluid under pressure, where said housing includes an axially slidable piston member having front and rear faces, and comparably shaped to said cross section, means for fluid sealing said piston member between said front and rear faces, energy storing means within said housing in contact with said piston member to effect its sliding movement; and, (b.) a canister end cap member closing said housing to define a cavity therewithin, where said end cap member includes an opening in communication with a nozzle mechanism, said nozzle mechanism comprising (i.) a conduit leading from said opening to a nozzle end, said nozzle end consisting of a cylindrical body portion of a first diameter, a smaller concentric portion having a nozzle face, and an annular shoulder separating said portions, (ii.) a cylindrical end cap, closed at one end and containing a central recess of a size to slidable engage said concentric portion, and, (iii.) a compression spring within said central recess to act against said nozzle face, where said cylindrical end cap, with said compression spring disposed therewithin, is secured to said cylindrical body portion by a solder which melts or softens at the at least said predetermined degree.

2. The fire suppressing device according to claim 1, wherein said energy storing means comprises at least one compression coil spring acting against said piston rear face.

3. The fire suppressing device according to claim 1, wherein said energy storing means comprises at least one stretchable elastic member extending between said piston front face and said end cap member.

4. The fire suppressing device according to claim 1, wherein said canister housing is cylindrical in shape.

5. The fire suppressing device according to claim 4, wherein said concentric portion includes an O-ring to facilitate a fluid sealing relationship with said cylindrical end cap.

6. The fire suppressing device according to claim 1, wherein said end cap member includes a one-way valve to inject said canister housing with fire suppressing fluid.

* * * * *